US005637044A

United States Patent [19]

Swash

[11] Patent Number: 5,637,044

[45] Date of Patent: Jun. 10, 1997

[54] GOLF CLUBS

[75] Inventor: Harold E. Swash, Birkdale, United Kingdom

[73] Assignee: Progear, Inc., Houston, Tex.

[21] Appl. No.: 542,413

[22] Filed: Oct. 12, 1995

[30] Foreign Application Priority Data

Oct. 14, 1994 [GB] United Kingdom ..... 9420733

[51] Int. Cl.[6] ..... A63B 53/04

[52] U.S. Cl. ..... 473/331; 473/251; 473/340

[58] Field of Search ..... 473/330, 324, 473/331, 342, 282, 340, 251, 238; D21/214, 215, 216, 217, 218, 219, 220

[56] References Cited

U.S. PATENT DOCUMENTS

| | | |
|---|---|---|
| D. 55,644 | 7/1920 | Reach . |
| D. 91,336 | 1/1934 | Thompson . |
| D. 138,440 | 8/1944 | Link . |
| D. 180,257 | 5/1957 | Wetzel . |
| D. 190,035 | 4/1961 | Hansen, Jr. . |
| D. 213,382 | 2/1969 | Risher . |
| D. 240,245 | 6/1976 | Aragona . |
| D. 271,783 | 12/1983 | Simmons . |
| D. 285,956 | 9/1986 | Shearer . |
| D. 302,715 | 8/1989 | Petersen . |
| 1,188,479 | 6/1916 | Park . |
| 1,289,553 | 12/1918 | Sanders . |
| 1,337,958 | 4/1920 | Reach . |
| 1,756,219 | 4/1930 | Spiker . |
| 1,965,954 | 7/1934 | Davis . |
| 2,083,189 | 6/1937 | Crooker . |
| 2,445,718 | 7/1948 | Sternberg et al. . |
| 3,260,525 | 7/1966 | Ortel . |
| 3,869,126 | 3/1975 | Thompson . |
| 4,067,572 | 1/1978 | Coleman . |
| 4,413,825 | 11/1983 | Sasse . |
| 4,754,971 | 7/1988 | Kobayashi . |
| 4,754,975 | 7/1988 | Aizawa . |
| 5,029,864 | 7/1991 | Keener . |
| 5,090,702 | 2/1992 | Viste . |
| 5,100,144 | 3/1992 | Okumoto et al. . |
| 5,158,289 | 10/1992 | Okumoto et al. . |
| 5,193,806 | 3/1993 | Burkly . |
| 5,282,624 | 2/1994 | Viste . |
| 5,348,301 | 9/1994 | Ma . |
| 5,354,059 | 10/1994 | Stuff . |
| 5,358,249 | 10/1994 | Mendralla . |
| 5,415,399 | 5/1995 | Kettleson . |

FOREIGN PATENT DOCUMENTS

| | | |
|---|---|---|
| 8509655 U | 5/1985 | Germany . |
| 2240933 | 8/1991 | United Kingdom . |
| 2267649 | 12/1993 | United Kingdom . |

*Primary Examiner*—Sebastiano Passaniti
*Attorney, Agent, or Firm*—Arnold, White & Durkee

[57] ABSTRACT

The invention disclosed herein is directed to a golf putter with a ball-striking face that has a plurality of grooves formed therein. In the preferred embodiment, the grooves are equally spaced concentric grooves with a common center that lies along a line parallel to a line passing through the sweet spot of the putter.

9 Claims, 2 Drawing Sheets

Fig. 1
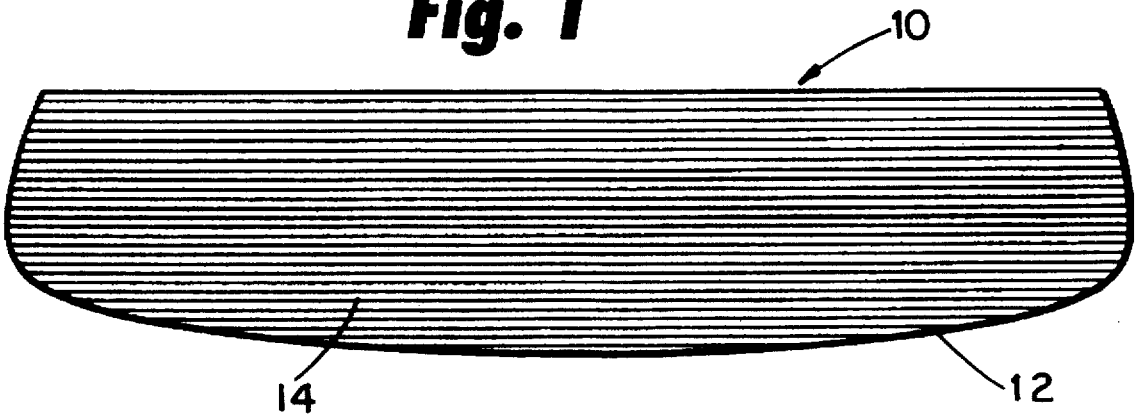
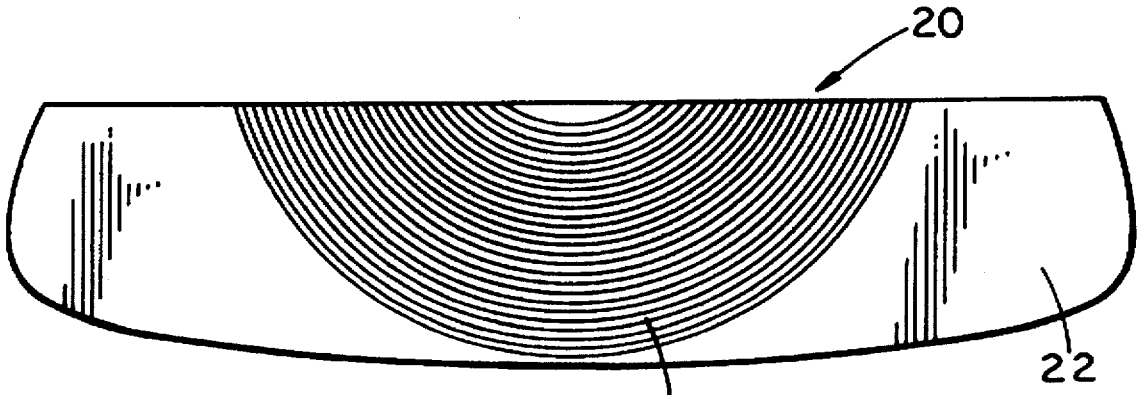
Fig. 2
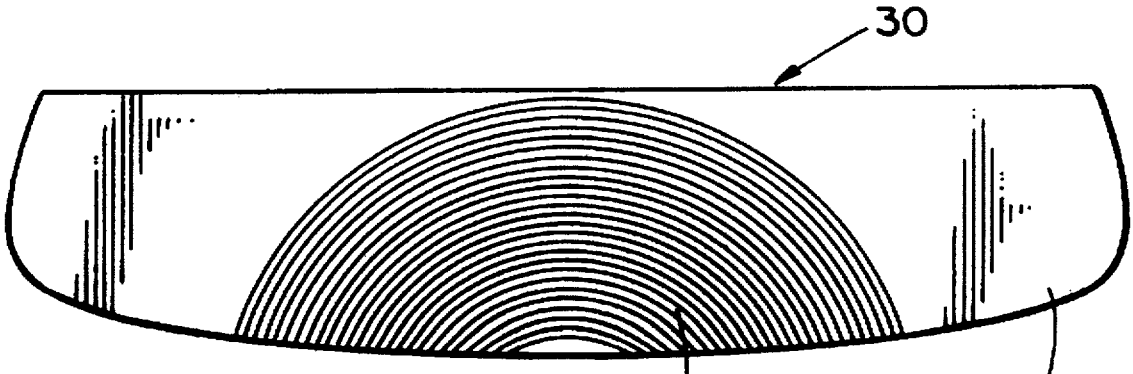
Fig. 3

Fig. 4
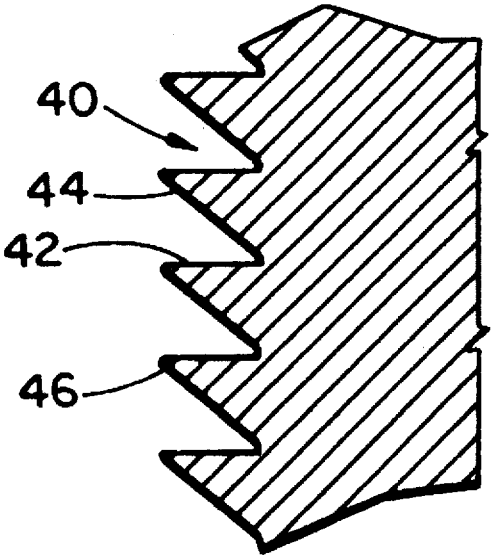
Fig. 5
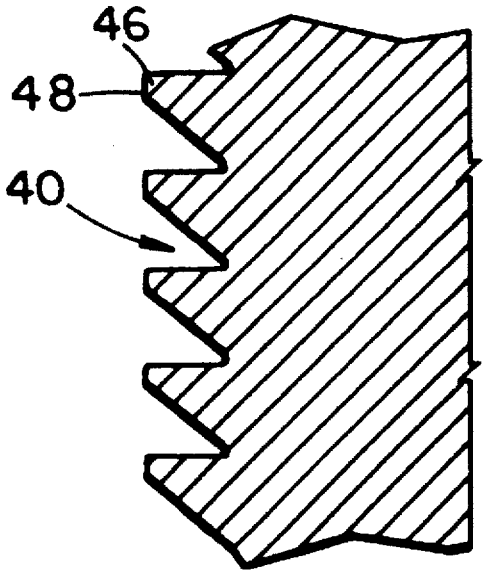
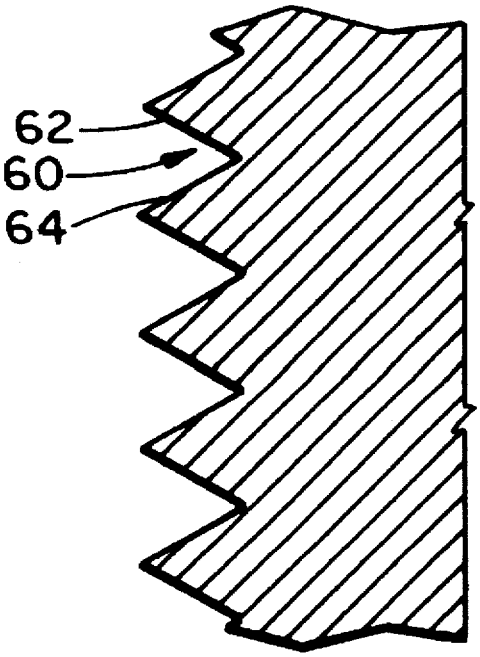
Fig. 6

GOLF CLUBS

BACKGROUND OF THE INVENTION

1. Field of the Invention

This invention relates in general to golf clubs and more particularly to golf putters.

2. Description of Related Art

Putters generally have a shaft and a head with a flat striking face that is substantially in a plane parallel to the plane of the putter shaft. For an accurate putt it is important to strike a golf ball squarely; otherwise undesirable spin may be imparted to the ball causing it to go off line. It is also better for the golf ball to be struck reasonably firmly so that it has a smooth roll over the putting green.

SUMMARY OF THE INVENTION

An object of this invention is to provide a golf putter that may facilitate the making of a putting stroke.

According to the invention there is provided a golf putter having a putting head attached to a shaft, the putting head having a golf ball striking face that has a plurality of grooves formed therein.

The striking face of the putter is preferably in a plane parallel with the putter shaft.

The grooves are preferably parallel and are preferably closely spaced, enclosing an acute angle. The grooves are preferably so closely spaced that a bottom or top edge of one groove is substantially co-terminus with a top or bottom edge respectively of an adjacent groove, although such co-termination may be truncated.

In one preferred embodiment each groove has one face that is substantially normal to the putter face with its other face inclined thereto. Such a groove may include an angle in the range of 15° to 250°, especially 20°.

In another preferred embodiment both groove faces are angled relative to a line perpendicular to the putter face. Such a groove may include an angle in the range of 50° to 700°, especially 60°.

The preferred grooves are relatively shallow in depth such as of the order of 0.2 to 0.3, especially 0.25 mm.

In one preferred embodiment grooves may be provided across the putter face so as to be transverse to the direction of putting.

In another preferred embodiment the grooves are arcuate and concentric, preferably having a notional center spaced from the putter head, especially either above or below the putter head in its normal use position. Such arcuate and concentric grooves are preferably positioned on the putter face so that they encompass the so-called sweet spot of the putter. Preferably the sweet spot of the putter will be on a diameter of the grooves, the diameter being generally vertical when the putter head is in its normal putting position.

BRIEF DESCRIPTION OF THE DRAWINGS

This invention will now be further described, by way of example only, with reference to the accompanying drawings, in which:

FIG. 1 shows a putter face according to a first embodiment of the invention;

FIG. 2 shows a putter face according to a second embodiment of the invention;

FIG. 3 shows a putter face according to a third embodiment of the invention;

FIG. 4 shows in section a first groove formation for a putter face according to the invention;

FIG. 5 shows in section a second groove formation for a putter face according to the invention; and FIG. 6 shows in section a third groove formation for a putter face according to the invention.

While the invention is susceptible to various modifications and alternative forms, a specific preferred embodiment has been shown in the drawings and will be described in detail herein. However, it should be understood that the invention is not intended to be limited to the particular form disclosed. Rather, the invention is to cover all modifications, equivalents and alternatives falling within the spirit and scope of the invention as defined by the appended claims.

DETAILED DESCRIPTION OF THE PREFERRED EMBODIMENTS

Referring to FIG. 1 of the accompanying drawings, a putter head 10 has a striking face 12 which is generally in a plane parallel to the putter shaft (not shown). In performing a putter stroke, it is a general intention to strike a golf ball with the striking face in a vertical plane relative to the putter surface. In FIG. 1 the striking face 12 of the putter has a series of parallel closely spaced grooves 14 formed therein.

The grooves 14 may be of any suitable cross-section and depth. Typically a groove depth in the order of 0.20 to 0.50 mm, preferably about 0.25 mm. Various suitable groove cross-sections are illustrated in FIGS. 4–6 of the accompanying drawings and will be described later.

In FIG. 2 a putter head 20 has a striking face 22 that has a series of closely spaced arcuate concentric grooves 24 formed therein. Each groove has a common center notionally spaced above the putter head and on a diameter passing through the so-called "sweet spot" of the putter, i.e., that part of the striking face with which it is best to strike a golf ball. Again, the grooves may be of any suitable cross-section and depth, examples only of which are shown in FIGS. 4–6 of the accompanying drawings.

FIG. 3 of the accompanying drawings shows a putter head 30 having a striking face 32 that has a series of closely spaced arcuate concentric grooves 34 formed therein. The grooves 34 are similar to that of FIG. 2 except that their notional center is below the putter head as shown.

As has been stated above, the grooves formed on a putter striking face can be of any suitable cross-section and depth and examples only are shown in FIGS. 4–6 of the drawings. In FIG. 4, grooves 40 are shown having a pair of faces 42, 44 meeting at an angle of approximately 20°, although that angle may be larger or smaller. One face 42 is normal to the putter face and the other face 44 is angled relative to the one face 42. The face 42 of one groove and the face 44 of the adjacent groove meet at a point to form a ridge 46. As shown, the face 42 always forms the lower side of a groove but the grooves could conceivably be the other way up.

In a slight variant of FIG. 4, as shown in FIG. 5, the ridges 46 are truncated to provide flat ends 48 parallel to the putter striking face.

Finally, in FIG. 6, grooves 60 are formed with pairs of faces 62 and 64 which are each included at 30° to the horizontal so as to include an angle of 60°. The actual angle is not thought to be particularly significant and may be more or less that 60°. The depth of the grooves 60 is about 0.25 mm but again may be more or less.

One advantage of grooves on a putter face is that spin can be imparted to a golf ball as it is struck, which may improve its roll along the putter surface particularly if the putter stroke has an upward element to it. In the case of the embodiments of FIGS. 2 and 3, them may be an additional advantage in that sideways spin may be imparted to a golf ball if it is struck with a downwards stroke plane by the putter outside the sweet spot. This generated side spin will tend to cause the ball to spin back towards a target line which would otherwise be missed due to a hook or slice stroke.

On further advantage, particularly of the embodiments of FIGS. 2 and 3, is that the grooves can add to the aesthetic appeal of a putter.

It is believed that preferred features of the invention may improve the quality of the roll of the ball from a good putting stroke and not be determined to a poorly struck putt.

What is claimed is:

1. A putter, comprising:

a putter head having a ball-striking face;

a shaft connected to said putter head; and a plurality of arcuate concentric grooves formed in said ball-striking face, said grooves having a common center of rotation that is located above or below said ball-striking face along a generally vertical line extending through the sweet spot of said putter head when the putter head is in its normal putting position.

2. A putter as described in claim 1, wherein at least some of said arcuate concentric grooves are equally spaced from adjacent grooves.

3. A putter as described in claim 1, wherein said grooves have a cross section defined by first and second faces, said first face being substantially perpendicular to the plane of said ball-striking face.

4. A putter as described in claim 3, wherein said first and second faces define an included angle of between 15 to 25 degrees.

5. A putter as described in claim 1, wherein each of said grooves has a bottom and top edge, the top and bottom edges of said grooves being substantially co-terminus with the bottom and top edges, respectively, of adjacent grooves.

6. A putter as described in claim 1, wherein said grooves have a cross section defined by first and second faces, said first and second faces of said grooves meet said second and first faces, respectively, of adjacent grooves so as to form an apex.

7. The putter as described in claim 1, wherein said grooves have a cross section defined by first and second faces that define an included angle of between 50 to 70 degree.

8. The putter as described in claim 7, wherein each of said first and second faces are angled at between 25 to 35 degrees with respect to a horizontal putting surface.

9. The putter as described in claim 7, wherein said first and second faces of said grooves meet said second and first faces, respectively, of adjacent grooves so as to form an apex.

* * * * *

UNITED STATES PATENT AND TRADEMARK OFFICE

CERTIFICATE OF CORRECTION

| | | |
|---|---|---|
| PATENT NO. | : | 5,637,044 |
| DATED | : | June 10, 1997 |
| INVENTOR(S) | : | Harold E. Swash |

It is certified that error appears in the above-identified patent and that said Letters Patent is hereby corrected as shown below:

Column 1, line 29, after "closely spaced." insert -- The grooves may be of any desired cross-section and may be of any desired depth. The preferred grooves preferably have a pair of convergent sides preferably --.

Column 1, line 41, change "700°" to -- 70° --.

Column 2, line 64, change "less that" to -- less than --.

Column 3, line 3, change "them" to -- there --.

Column 3, line 9, change "On" to -- One --.

Column 4, line 19 (line 4 of claim 7), change "degree" to -- degrees --.

Signed and Sealed this

Ninth Day of September, 1997

*Attest:*

Bruce Lehman

BRUCE LEHMAN

*Attesting Officer*

*Commissioner of Patents and Trademarks*